US006889186B1

(12) United States Patent
Michaelis

(10) Patent No.: US 6,889,186 B1
(45) Date of Patent: May 3, 2005

(54) METHOD AND APPARATUS FOR IMPROVING THE INTELLIGIBILITY OF DIGITALLY COMPRESSED SPEECH

(75) Inventor: Paul Roller Michaelis, Louisville, CO (US)

(73) Assignee: Avaya Technology Corp., Basking Ridge, NJ (US)

( * ) Notice: Subject to any disclaimer, the term of this patent is extended or adjusted under 35 U.S.C. 154(b) by 818 days.

(21) Appl. No.: 09/586,183

(22) Filed: Jun. 1, 2000

(51) Int. Cl.[7] ..... G10L 21/02
(52) U.S. Cl. ..... 704/225; 704/208; 704/214
(58) Field of Search ..... 704/225, 208, 704/214, 227, 254

(56) References Cited

U.S. PATENT DOCUMENTS

| | | | | | |
|---|---|---|---|---|---|
| 4,468,804 | A | | 8/1984 | Kates et al. | 381/47 |
| 4,696,039 | A | * | 9/1987 | Doddington | 704/215 |
| 4,852,170 | A | * | 7/1989 | Bordeaux | 704/277 |
| 5,018,200 | A | * | 5/1991 | Ozawa | 704/222 |
| 5,583,969 | A | * | 12/1996 | Yoshizumi et al. | 704/254 |

FOREIGN PATENT DOCUMENTS

| | | | | |
|---|---|---|---|---|
| CA | 1333425 | | 9/1989 | G10L/9/14 |
| EP | 82305275.8 | | 10/1982 | G10L/1/00 |
| EP | 84112266.6 | | 10/1984 | G10L/9/18 |
| EP | 89117463.3 | | 9/1989 | G10L/9/14 |
| JP | 10-124089 | * | 5/1998 | G10L/3/02 |

OTHER PUBLICATIONS

Sadaoki Furui, "Digital Speech Processing, Synthesis, and Recognition," Marcel Dekker, Inc., New York, 1989, pp. 191–194 and 320–322.*

Sadaoki Furui, "Digital Speech Processing, Synthesis, and Recognition," Marcel Dekker, Inc., New York, 1989, pp. 70–81, 168–204.*

* cited by examiner

*Primary Examiner*—Vijay Chawan
*Assistant Examiner*—Donald L. Storm
(74) *Attorney, Agent, or Firm*—Sheridan Ross P.C.

(57) ABSTRACT

A system for processing a speech signal to enhance signal intelligibility identifies portions of the speech signal that include sounds that typically present intelligibility problems and modifies those portions in an appropriate manner. First, the speech signal is divided into a plurality of time-based frames. Each of the frames is then analyzed to determine a sound type associated with the frame. Selected frames are then modified based on the sound type associated with the frame or with surrounding frames. For example, the amplitude of frames determined to include unvoiced plosive sounds may be boosted as these sounds are known to be important to intelligibility and are typically harder to hear than other sounds in normal speech. In a similar manner, the amplitudes of frames preceding such unvoiced plosive sounds can be reduced to better accentuate the plosive. Such techniques will make these sounds easier to distinguish upon subsequent playback.

35 Claims, 4 Drawing Sheets

METHOD AND APPARATUS FOR IMPROVING THE INTELLIGIBILITY OF DIGITALLY COMPRESSED SPEECH

TECHNICAL FIELD

The invention relates generally to speech processing and, more particularly, to techniques for enhancing the intelligibility of processed speech.

BACKGROUND OF THE INVENTION

Human speech generally has a relatively large dynamic range. For example, the amplitudes of some consonant sounds (e.g., the unvoiced consonants P, T, S, and F) are often 30 dB lower than the amplitudes of vowel sounds in the same spoken sentence. Therefore, the consonant sounds will sometimes drop below a listener's speech detection threshold, thus compromising the intelligibility of the speech. This problem is exacerbated when the listener is hard of hearing, the listener is located in a noisy environment, or the listener is located in an area that receives a low signal strength.

Traditionally, the potential unintelligibility of certain sounds in a speech signal was overcome using some form of amplitude compression on the signal. For example, in one prior approach, the amplitude peaks of a speech signal were clipped and the resulting signal was amplified so that the difference between the peaks of the new signal and the low portions of the new signal would be reduced while maintaining the signal's original loudness. Amplitude compression, signal. In addition, amplitude compression techniques tend to amplify some undesired low-level signal components (e.g., background noise) in an inappropriate manner, thus compromising the quality of the resultant signal.

Therefore, there is a need for a method and apparatus that is capable of enhancing the intelligibility of processed speech without the undesirable effects associated with prior techniques.

SUMMARY OF THE INVENTION

The present invention relates to a system that is capable of significantly enhancing the intelligibility of processed speech. The system first divides the speech signal into frames or segments as is commonly performed in certain low bit rate speech encoding algorithms, such as Linear Predictive Coding (LPC) and Code Excited Linear Prediction (CELP). The system then analyzes the spectral content of each frame to determine a sound type associated with that frame. The analysis of each frame will typically be performed in the context of one or more other frames surrounding the frame of interest. The analysis may determine, for example, whether the sound associated with the frame is a vowel sound, a voiced fricative, or an unvoiced plosive.

Based on the sound type associated with a particular frame, the system will then modify the frame if it is believed that such modification will enhance intelligibility. For example, it is known that unvoiced plosive sounds commonly have lower amplitudes than other sounds within human speech. The amplitudes of frames identified as including unvoiced plosives are therefore boosted with respect to other frames. In addition to modifying a frame based on the sound type associated with that frame, the system may also modify frames surrounding that particular frame based on the sound type associated with the frame.

For example, if a frame of interest is identified as including an unvoiced plosive, the amplitude of the frame preceding this frame of interest can be reduced to ensure that the plosive isn't mistaken for a spectrally similar fricative. By basing frame modification decisions on the type of speech included within a particular frame, the problems created by blind signal modifications based on amplitude (e.g., boosting all low-level signals) are avoided. That is, the inventive principles allow frames to be modified selectively and intelligently to achieve an enhanced signal intelligibility.

DETAILED DESCRIPTION

The present invention relates to a system that is capable of significantly enhancing the intelligibility of processed speech. The system determines a sound type associated with individual frames of a speech signal and modifies those frames based on the corresponding sound type. In one approach, the inventive principles are implemented as an enhancement to well-known speech encoding algorithms, such as the LPC and CELP algorithms, that perform frame-based speech digitization. The system is capable of improving the intelligibility of speech signals without generating the distortions often associated with prior art amplitude clipping techniques. The inventive principles can be used in a variety of speech applications including, for example, messaging systems, IVR applications, and wireless telephone systems. The inventive principles can also be implemented in devices designed to aid the hard of hearing such as, for example, hearing aids and cochlear implants.

Figure 1:
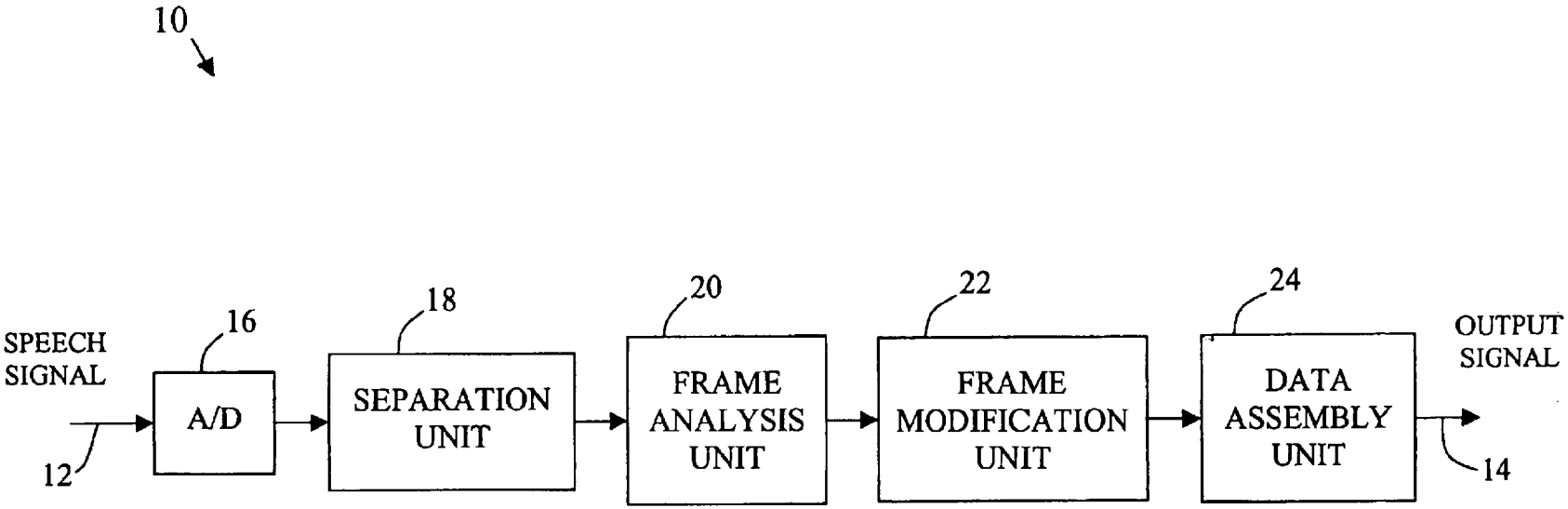
FIG. 1 is a block diagram illustrating a speech processing system in accordance with one embodiment of the present invention.

FIG. 1 is a block diagram illustrating a speech processing system 10 in accordance with one embodiment of the present invention. The speech processing system 10 receives an analog speech signal at an input port 12 and converts this signal to a compressed digital speech signal which is output at an output port 14. In addition to performing signal compression and analog to digital conversion functions on the input signal, the system 10 also enhances the intelligibility of the input signal for later playback. As illustrated, the speech processing system 10 includes: an analog to digital (A/D) converter 16, a frame separation unit 18, a frame analysis unit 20, a frame modification unit 22, and a compression unit 24. It should be appreciated that the blocks illustrated in FIG. 1 are functional in nature and do not necessarily correspond to discrete hardware elements. In one embodiment, for example, the speech processing system 10 is implemented within a single digital processing device. Hardware implementations, however, are also possible.

With reference to FIG. 1, the analog speech signal received at port 12 is first sampled and digitized within the A/D converter 16 to generate a digital waveform for delivery to the frame separation unit 18. The frame separation unit 18 is operative for dividing the digital waveform into individual time-based frames. In a preferred approach, these frames are each about 20 to 25 milliseconds in length. The frame analysis unit 20 receives the frames from the frame separation unit 18 and performs a spectral analysis on each individual frame to determine a spectral content of the frame. The frame analysis unit 20 then transfers each frame's spectral information to the frame modification unit 22. The frame modification unit 22 uses the results of the spectral analysis to determine a sound type (or type of speech) associated with each individual frame. The frame modification unit 22 then modifies selected frames based on the identified sound types. The frame modification unit 22 will normally analyze the spectral information corresponding to a frame of interest and also the spectral information corresponding to one or more frames surrounding the frame of interest to determine a sound type associated with the frame of interest.

The frame modification unit 22 includes a set of rules for modifying selected frames based on the sound type associated therewith. In one embodiment, the frame modification unit 22 also includes rules for modifying frames surrounding a frame of interest based on the sound type associated with the frame of interest. The rules used by the frame modification unit 22 are designed to increase the intelligibility of the output signal generated by the system 10. Thus, the modifications are intended to emphasize the characteristics of particular sounds that allow those sounds to be distinguished from other similar sounds by the human ear. Many of the frames may remain unmodified by the frame modification unit 22 depending upon the specific rules programmed therein.

The modified and unmodified frame information is next transferred to the data assembly unit 24 which assembles the spectral information for all of the frames to generate the compressed output signal at output port 14. The compressed output signal can then be transferred to a remote location via a communication medium or stored for later decoding and playback. It should be appreciated that the intelligibility enhancement functions of the frame modification unit 22 of FIG. 1 can alternatively (or additionally) be performed as part of the decoding process during signal playback.

In one embodiment, the inventive principles are implemented as an enhancement to certain well-known speech encoding and/or decoding algorithms, such as the Linear Predictive Coding (LPC) algorithm and the Code-Excited Linear Prediction (CELP) algorithm. In fact, the inventive principles can be used in conjunct ion with virtually any speech digitization (i.e., breaking up speech into individual time-based frames and then capturing the spectral content of each frame to generate a digital representation of the speech). Typically, these algorithms utilize a mathematical model of human vocal tract physiology to describe each frame's spectral content in terms of human speech mechanism analogs, such as overall amplitude, whether the frame's sound is voiced or unvoiced, and, if the sound is voiced, the pitch of the sound. This spectral information is then assembled into a compressed digital speech signal. A more detailed description of various speech digitization algorithms that can be modified in accordance with the present invention can be found in the paper "Speech Digitization and Compression" by Paul Michaelis, International Encyclopedia of Ergonomics and Human Factors, edited by Waldamar Karwowski, published by Taylor & Francis, London, 2000, which is hereby incorporated by reference.

In accordance with one embodiment of the invention, the spectral information generated within such algorithms (and possibly other spectral information) is used to determine a sound type associated with each frame. Knowledge about which sound types are important for intelligibility and are typically harder to hear is then used to develop rules for modifying the frame information in a manner that increases intelligibility. The rules are then used to modify the frame information of selected frames based on the determined sound type. The spectral information for each of the frames, whether modified or unmodified, is then used to develop the compressed speech signal in a conventional manner (e.g., the manner typically used by the LPC, CELP, or other similar algorithms).

Figure 2:
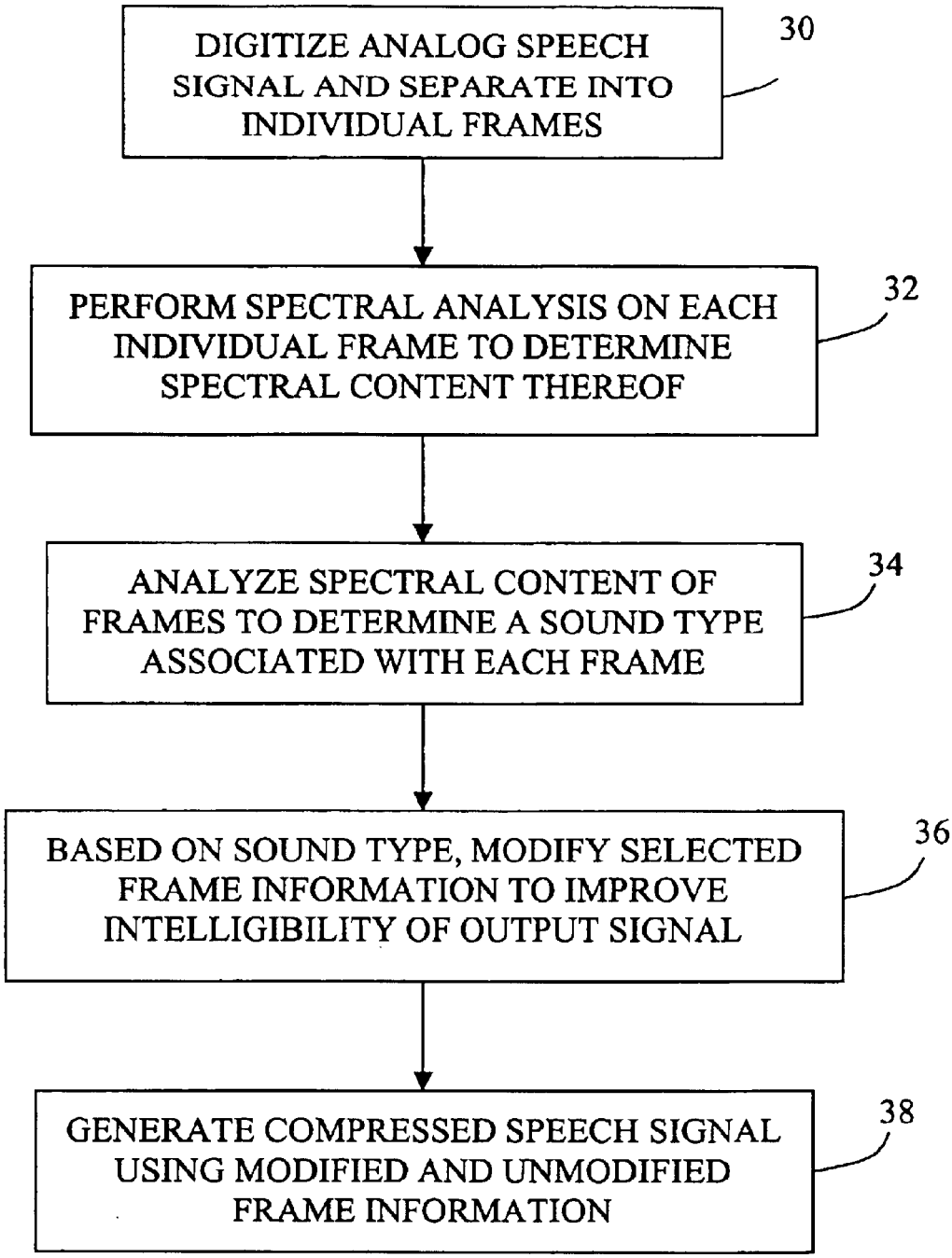
FIG. 2 is a flowchart illustrating a method for processing a speech signal in accordance with one embodiment of the invention.

FIG. 2 is a flowchart illustrating a method for processing an analog speech signal in accordance with one embodiment of the present invention. First, the speech signal is digitized and separated into individual frames (step 30). A spectral analysis is then performed on each individual frame to determine a spectral content of the frame (step 32). Typically, spectral parameters such as amplitude, voicing, and pitch (if any) of sounds will be measured during the spectral analysis. The spectral content of the frames is next analyzed to determine a sound type associated with each frame (step 34). To determine the sound type associated with a particular frame, the spectral content of other frames surrounding the particular frame will often be considered. Based on the sound type associated with a frame, information corresponding to the frame may be modified to improve the intelligibility of the output signal (step 36). Information corresponding to frames surrounding a frame of interest may also be modified based on the sound type of the frame of interest. Typically, the modification of the frame information will include boosting or reducing the amplitude of the corresponding frame. However, other modification techniques are also possible. For example, the reflection coefficients that govern spectral filtering can be modified in accordance with the present invention. The spectral information corresponding to the frames, whether modified or unmodified, is then assembled into a compressed speech signal (step 38). This compressed speech signal can later be decoded to generate an audible speech signal having enhanced intelligibility.

Figure 3:
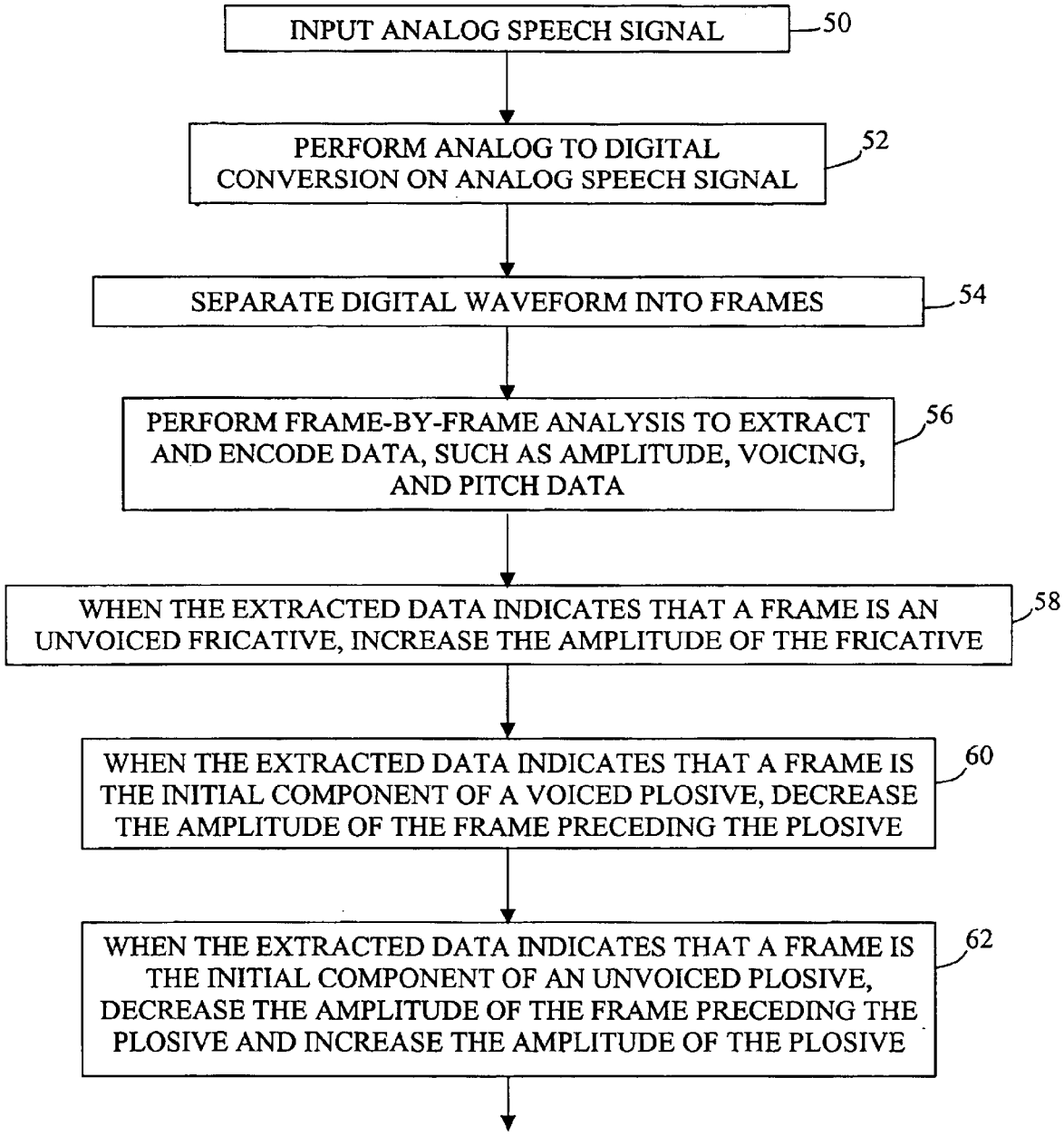
FIGS. 3 and 4 are portions of a flowchart illustrating a method for use in enhancing the intelligibility of speech signals in accordance with one embodiment of the present invention.
Figure 4:
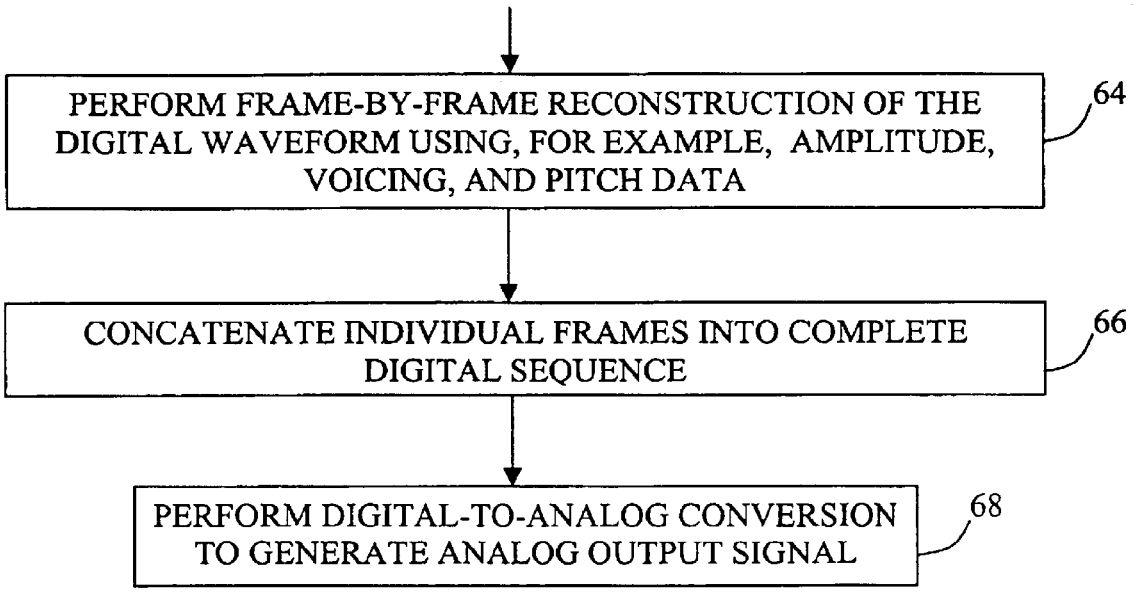

FIGS. 3 and 4 are portions of a flowchart illustrating a method for use in enhancing the intelligibility of speech signals in accordance with one embodiment of the present invention. The method is operative for identifying unvoiced fricatives and voiced and unvoiced plosives within a speech signal and for adjusting the amplitudes of corresponding frames of the speech signal to enhance intelligibility. Unvoiced fricatives and unvoiced plosives are sounds that are typically lower in volume in a speech signal than other sounds in the signal. In addition, these sounds are usually very important to the intelligibility of the underlying speech. A voiced speech sound is one that is produced by tensing the vocal cords while exhaling, thus giving the sound a specific pitch caused by vocal cord vibration. The spectrum of a voiced speech sound therefore includes a fundamental pitch and harmonics thereof. An unvoiced speech sound is one that is produced by audible turbulence in the vocal tract and for which the vocal cords remain relaxed. The spectrum of an unvoiced speech signal is typically similar to that of white noise.

With reference to FIG. 3, an analog speech signal is first received (step 50) and then digitized (step 52). The digital waveform is then separated into individual frames (step 54). In a preferred approach, these frames are each about 20 to 25 milliseconds in length. A frame-by-frame analysis is then performed to extract and encode data from the frames, such as amplitude, voicing, pitch, and spectral filtering data (step 56). When the extracted data indicates that a frame includes an unvoiced fricative, the amplitude of that frame is increased in a manner that is designed to increase the likelihood that the loudness of the sound in a resulting speech signal exceeds a listener's detection threshold (step 58). The amplitude of the frame can be increased, for example, by a predetermined gain value, to a predetermined amplitude value, or the amplitude can be increased by an amount that depends upon the amplitudes of the other frames within the same speech signal. A fricative sound is produced by forcing air from the lungs through a constriction in the vocal tract that generates audible turbulence. Examples of unvoiced fricatives include the "f" in fat, the "s" in sat, and the "ch" in chat. Fricative sounds are characterized by a relatively constant amplitude over multiple sample periods. Thus, an unvoiced fricative can be identified by comparing the amplitudes of multiple successive frames after a decision has been made that the frames correspond to unvoiced sounds.

When the extracted data indicates that a frame is the initial component of a voiced plosive, the amplitude of the frame preceding the voiced plosive is reduced (step 60). A plosive is a sound that is produced by the complete stoppage and then sudden release of the breath. Plosive sounds are thus characterized by a sudden drop in amplitude followed by a sudden rise in amplitude within a speech signal. An example of voiced plosives includes the "b" in bait, the "d" in date, and the "g" in gate. Plosives are identified within a speech signal by comparing the amplitudes of adjacent frames in the signal. By decreasing the amplitude of the frame preceding the voiced plosive, the amplitude "spike" that characterizes plosive sounds is accentuated, resulting in enhanced intelligibility.

When the extracted data indicates that a frame is the initial component of an unvoiced plosive, the amplitude of the frame preceding the unvoiced plosive is decreased and the amplitude on the frame including the unvoiced plosive is increased (step 62). The amplitude of the frame preceding the unvoiced plosive is decreased to emphasize the amplitude "spike" of the plosive as described above. The amplitude of the frame including the initial component of the unvoiced plosive is increased to increase the likelihood that the loudness of the sound in a resulting speech signal exceeds a listener's detection threshold.

With reference to FIG. 4, a frame-by-frame reconstruction of the digital waveform is next performed using, for example, the amplitude, voicing, pitch, and spectral filtering data (step 64). The individual frames are then concatenated into a complete digital sequence (step 66). A digital to analog conversion is then performed to generate an analog output signal (step 68). The method illustrated in FIGS. 4 and 5 can be performed all at one time as part of a real-time intelligibility enhancement procedure or it can be performed in multiple sub-procedures at different times. For example, if the method is implemented within a hearing aid, the entire method will be used to transform an input analog speech signal into an enhanced output analog speech signal for detection by a user of the hearing aid. In an alternative implementation, steps 50 through 62 may be performed as part of a speech signal encoding procedure while steps 64 through 68 are performed as part of a subsequent speech signal decoding procedure. In another alternative implementation, steps 50 through 56 are performed as part of a speech signal encoding procedure while steps 58 through 68 are performed as part of a subsequent speech decoding procedure. In the period between the encoding procedure and the decoding procedure, the speech signal can be stored within a memory unit or be transferred between remote locations via a communication channel. In a preferred implementation, steps 50 through 56 are preformed using well-known LPC or CELP encoding techniques. Similarly, steps 64 through 68 are preferably performed using well-known LPC or CELP decoding techniques.

In a similar manner to th at described above, the inventive principles can be used to enhance the intelligibility of other sound types. Once it has been determined that a particular type of sound presents an intelligibility problem, it is next determined how that type of sound can be identified within a frame of a speech signal (e.g., through the use of spectral analysis techniques and comparisons between adjacent frames). It is then determined how a frame including such a sound needs to be modified to enhance the intelligibility of the sound when the compressed signal is later decoded and played back. Typically, the modification will include a simple boosting of the amplitude of the corresponding frame, although other types of frame modification are also possible in accordance with the present invention (e.g., modifications to the reflection coefficients that govern spectral filtering).

An important feature of the present invention is that compressed speech signals generated using the inventive principles can usually be decoded using conventional decoders (e.g., LPC of CELP decoders) that have not been modified in accordance with the invention. In addition, decoders that have been modified in accordance with the present invention can also be used to decode compressed speech signals that were generated without using the principles of the present invention. Thus, systems using the inventive techniques can be upgraded piecemeal in an economical fashion without concern about widespread signal incompatibility within the system.

Although the present invention has been described in conjunction with its preferred embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. A method for processing a speech signal comprising the steps of:

receiving a speech signal to be processed;

dividing said speech signal into multiple frames;

analyzing a frame generated in said dividing step to determine a spoken sound type associated with said frame; and modifying a sound parameter of at least one of said frame and another frame based on said spoken sound type;

wherein said step of modifying at least one of said frame and another frame includes reducing an amplitude of a previous frame when said frame is determined to comprise a voiced or unvoiced plosive.

2. The method claimed in claim 1, wherein:

said step of analyzing includes performing a spectral analysis on said frame to determine a spectral content of said frame.

3. The method in clam 2, wherein:

said step of analyzing includes examining said spectral content of said frame to determine whether said frame includes a voiced or unvoiced plosive.

4. The method claimed in claim 1, wherein:

said step of analyzing includes determining an amplitude of said frame and comparing said amplitude of said frame to an amplitude of a previous frame to determine whether said frame includes a plosive sound.

5. The method claimed in claim 1, wherein:

said step of modifying at least one of said frame and another frame further comprises boosting an amplitude of said frame when said frame is determined to include an unvoiced plosive.

6. The method claimed in claim 1, wherein:

said step of modifying at least one of said frame and another frame further includes changing a parameter associated with said frame in a manner that enhances intelligibility of an output signal.

7. The method of claim 1, wherein:

said step of modifying at least one of said frame and another frame based on said spoken sound type comprises modifying said frame and said another frame.

8. A computer readable medium having program instructions stored thereon for implementing the method of claim 1 when executed within a digital processing device.

9. A method for processing a speech signal comprising the steps of:

providing a speech signal that is divided into time-based frames;

analyzing each frame of said frames in the context of surrounding frames to determine a spoken sound type associated with said frame; and adjusting an amplitude of selected frames based on a result of said step of analyzing;

wherein said step of adjusting includes decreasing the amplitude of a second frame that precedes said frame when said frame is determined to include a voiced or unvoiced plosive.

10. The method of claim 9, wherein:

said step of adjusting includes adjusting the amplitude of a second frame in a manner that enhances intelligibility of an output signal.

11. The method of claim 9, wherein:

said step of adjusting further comprises increasing the amplitude of said frame when said spoken sound type associated with said frame includes an unvoiced plosive.

12. The method of claim 9, wherein:

said step of adjusting includes increasing the amplitude of a second frame when said spoken sound type associated with said second frame includes an unvoiced fricative.

13. The method of claim 9, wherein:

said step of analyzing includes comparing an amplitude of a first frame to an amplitude of a frame previous to said first frame.

14. A computer readable medium having program instructions stored thereto for implementing the method claimed in claim 9 when executed in a digital processing device.

15. A system for processing a speech signal comprising:

means for receiving a speech signal that is divided into time-based frames;

means for determining a spoken sound type associated with each of said frames; and means for modifying a sound parameter of selected frames based on spoken sound type to enhance signal intelligibility;

wherein said means for modifying includes a means for reducing the amplitude of a frame that precedes a frame that comprises a voiced or unvoiced plosive.

16. The system claimed in claim 15, wherein:

said system is implemented within a linear predictive coding (LPC) encoder.

17. The system claimed in claim 15, wherein:

said system is implemented within a code excited linear prediction (CELP) encoder.

18. The system claimed in claim 15, wherein:

said system is implemented within a linear predictive coding (LPC) decoder.

19. The system claimed in claim 15, wherein:

said system is implemented within a code excited linear prediction (CELP) decoder.

20. The system claimed in claim 15, wherein:

said means for determining includes means for performing a spectral analysis on a frame.

21. The system claimed in claim 15, wherein:

said means for determining includes means for comparing amplitudes of adjacent frames.

22. The system claimed in claim 15, wherein:

said means for determining includes means for ascertaining whether a frame includes a voiced or unvoiced sound.

23. The system claimed in claim 15, wherein:

said means for modifying further includes means for boosting the amplitude of a second frame that includes a spoken sound type that is typically less intelligible than other sound types.

24. The system claimed in claim 15, wherein:

said means for modifying further comprises means for boosting the amplitude of a frame that includes an unvoiced plosive.

25. The system claimed in claim 15, wherein:

said means for determining a spoken sound type includes means for determining whether a frame includes at least one of the following: a vowel sound, a voiced fricative, an unvoiced fricative, a voiced plosive, and an unvoiced plosive.

26. A method for processing a speech signal comprising the steps of:

receiving a speech signal to be processed;

dividing said speech signal into multiple frames;

analyzing a frame generated in said dividing step to determine a spoken sound type associated with said frame; and modifying a sound parameter of said frame and another frame based on said spoken sound type;

wherein said step of modifying said frame and said another frame includes reducing an amplitude of a previous frame when said spoken sound type is an unvoiced plosive.

27. A method for processing a speech signal comprising the steps of:

providing a speech signal that is divided into time-based frames;

analyzing each frame of said frames in the context of surrounding frames to determine a spoken sound type associated with said frame; and adjusting an amplitude of selected frames based on result of said step of analyzing;

wherein said step of adjusting includes decreasing the amplitude of a second frame that is previous to said frame when said spoken sound type associated with said frame includes a voiced or unvoiced plosive.

28. A system for processing a speech signal comprising:

means for receiving a speech signal that is divided into time-based frames;

means for determining a spoken sound type associated with each of said frames; and means for modifying a sound parameter of selected frames based on spoken sound type to enhance signal intelligibility;

wherein said means for modifying includes means for reducing the amplitude of a frame that precedes a frame that includes an unvoiced plosive.

29. A method for processing a speech signal comprising the steps of:

receiving a speech signal to be processed;

dividing said speech signal into multiple frames;

analyzing a frame generated in said dividing step to determine a fricative sound type associated with said frame; and boosting an amplitude of said frame when said frame comprises an unvoiced fricative sound type but not boosting the amplitude of said frame when said frame comprises a voiced fricative.

30. The method of claim 29, wherein:

said step of analyzing includes performing a spectral analysis on said frame to determine a spectral content of said frame.

31. The method claimed in claim 30, wherein:

said step of analyzing includes examining said spectral content of said frame to determine whether said frame includes a voiced or unvoiced fricative.

32. The method of claim 29, wherein:

said step of analyzing includes determining an amplitude of said frame and comparing said amplitude of said frame to an amplitude of a previous frame to determine whether said frame includes a plosive sound.

33. The method claimed in claim 29, wherein:

said step of boosting an amplitude of said frame further includes changing a parameter associated with said frame in a manner that enhances intelligibility of an output signal.

34. The method claimed in claim 29, wherein:

said step of boosting an amplitude of said frame further comprises modifying another frame.

35. A computer readable medium having program instructions stored thereon for implementing the method of claim 29 when executed within a digital processing device.

* * * * *